US009943742B2

(12) United States Patent
Burt, Jr.

(10) Patent No.: US 9,943,742 B2
(45) Date of Patent: Apr. 17, 2018

(54) TRAINING AID FOR BOXING

(71) Applicant: Amzi B. Burt, Jr., Clarksdale, MS (US)

(72) Inventor: Amzi B. Burt, Jr., Clarksdale, MS (US)

( * ) Notice: Subject to any disclaimer, the term of this patent is extended or adjusted under 35 U.S.C. 154(b) by 0 days.

(21) Appl. No.: 14/737,366

(22) Filed: Jun. 11, 2015

(65) Prior Publication Data

US 2015/0360110 A1 Dec. 17, 2015

Related U.S. Application Data

(60) Provisional application No. 62/010,520, filed on Jun. 11, 2014.

(51) Int. Cl.

| | |
|---|---|
| ***A63B 24/00*** | (2006.01) |
| ***A63B 69/32*** | (2006.01) |
| ***A63B 69/00*** | (2006.01) |
| ***A63B 69/34*** | (2006.01) |
| ***A63B 71/06*** | (2006.01) |

(52) U.S. Cl.

CPC ..... *A63B 69/32* (2013.01); *A63B 69/0053* (2013.01); *A63B 69/34* (2013.01); *A63B 71/0622* (2013.01); *A63B 24/0075* (2013.01); *A63B 24/0084* (2013.01); *A63B 2071/0625* (2013.01); *A63B 2207/02* (2013.01); *A63B 2225/093* (2013.01); *A63B 2225/50* (2013.01)

(58) Field of Classification Search

CPC ..... A63B 69/20–69/35; A63B 69/345; A63B 2244/102; A63B 2220/53; A63B 2244/10–2244/106

USPC ..... 482/83–90

See application file for complete search history.

(56) References Cited

U.S. PATENT DOCUMENTS

| | | | | |
|---|---|---|---|---|
| 1,685,495 | A * | 9/1928 | Latz | A63B 69/206 223/67 |
| 4,088,315 | A * | 5/1978 | Schemmel | A63B 69/34 482/4 |
| 4,974,833 | A * | 12/1990 | Hartman | A63B 69/004 273/445 |
| 5,921,896 | A * | 7/1999 | Boland | A63B 69/004 482/3 |
| 6,110,079 | A * | 8/2000 | Luedke | A63B 24/0062 446/268 |
| 7,601,099 | B2 * | 10/2009 | Kang | A63B 69/00 434/250 |
| 7,909,749 | B2 * | 3/2011 | Sheedy | A63B 24/0006 482/148 |
| 8,419,436 | B2 * | 4/2013 | Perez | A63B 69/32 434/247 |

(Continued)

FOREIGN PATENT DOCUMENTS

WO WO 2013071408 A1 * 5/2013 ..... A63B 69/0053

*Primary Examiner* — Gregory Winter

(74) *Attorney, Agent, or Firm* — Dunlap Bennett & Ludwig PLLC

(57) ABSTRACT

A boxing trainer includes a housing and a controller. The housing includes a plurality of targets. Each of the plurality of targets includes a target pad and a light operable to illuminate the target pad. The controller includes a plurality of target commands. Each target command is linked to and corresponds with one of the targets. Therefore, activating one of the target commands will activate the light of one of the target pads that the target command is linked with.

7 Claims, 2 Drawing Sheets

(56) References Cited

U.S. PATENT DOCUMENTS

| | | | | |
|---|---|---|---|---|
| 9,227,128 | B1 * | 1/2016 | Carfagna, Jr. | A63B 69/32 |
| 2008/0008984 | A1 * | 1/2008 | McDonald | A63B 69/004<br>434/247 |
| 2008/0076636 | A1 * | 3/2008 | Smith | A63B 69/004<br>482/1 |
| 2010/0130333 | A1 * | 5/2010 | Strong | A63B 69/004<br>482/83 |
| 2011/0245045 | A1 * | 10/2011 | Blaies | A63B 69/34<br>482/84 |
| 2013/0040764 | A1 * | 2/2013 | Daniels | A63B 69/00<br>473/439 |
| 2013/0130759 | A1 * | 5/2013 | Boi | A63F 13/005<br>463/2 |
| 2014/0100084 | A1 * | 4/2014 | Gabara | G09B 19/0038<br>482/4 |
| 2014/0206504 | A1 * | 7/2014 | Barreras | A63B 69/32<br>482/8 |
| 2014/0309082 | A1 * | 10/2014 | Iglehart | A63B 69/32<br>482/9 |
| 2014/0366645 | A1 * | 12/2014 | Tsai | G01L 5/0052<br>73/862.041 |
| 2014/0369695 | A1 * | 12/2014 | D'Andrade | A63B 69/0053<br>398/162 |
| 2015/0094191 | A1 * | 4/2015 | Fradin | A63B 24/0062<br>482/8 |
| 2015/0375079 | A1 * | 12/2015 | Wood | A63B 69/32<br>482/8 |
| 2016/0367856 | A1 * | 12/2016 | DePompe | A63B 24/0075 |

* cited by examiner

TRAINING AID FOR BOXING

CROSS-REFERENCE TO RELATED APPLICATION

This application claims the benefit of priority of U.S. provisional application No. 62/010,520, filed Jun. 11, 2014, the contents of which are herein incorporated by reference.

BACKGROUND OF THE INVENTION

The present invention relates to a training aid and, more particularly, to a boxer training aid.

Boxing is a combat sport in which two people engage in a contest of strength, speed, reflexes, endurance, and will, by throwing punches with gloved hands against each other. Professional and amateur boxers train for many hours in preparation for a fight. It is important to train one's agility, strength, accuracy, and speed.

As can be seen, there is a need for improved training aids to help boxers prepare for fights.

SUMMARY OF THE INVENTION

In one aspect of the present invention, a boxing trainer comprises: a housing comprising a plurality of targets, wherein each target comprises: a target pad and at least one light operable to illuminate the target pad; and a controller comprising a plurality of target commands each linked to the light of one of the targets such that activating one of the target commands activates one of the lights.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a device that develops hand speed and accuracy and simulates openings which might occur during a fight. The present invention is an artificial aid for training in the offensive aspects of boxing. The present invention may include targets that light up indicating to punch the target and to indicate what type of punch should be delivered. Therefore, the training user may develop an improved ability to throw rapid punch combinations. Further, the artificial aid may be controlled by a third party, using a remote control.

Figure 1:
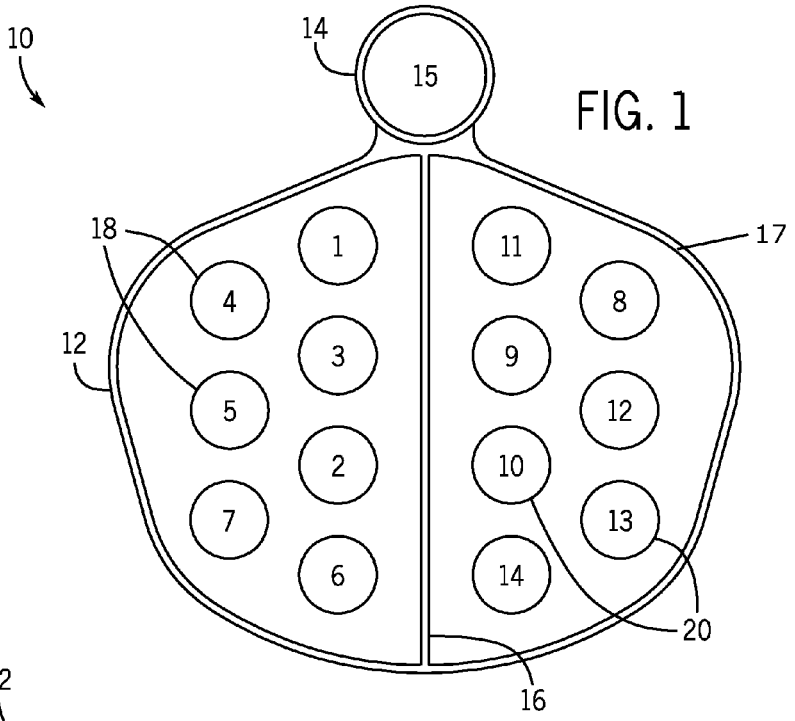
FIG. 1 is a front elevation view of the first embodiment of the present invention.
Figure 2:
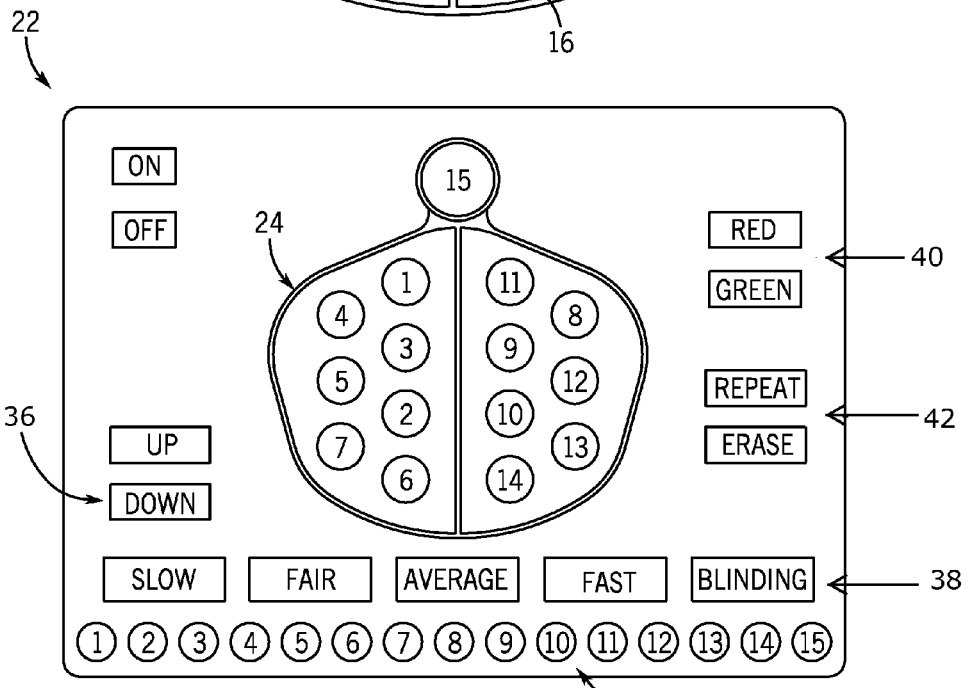
FIG. 2 is a top plan view of the control panel of an embodiment of the present invention.
Figure 3:
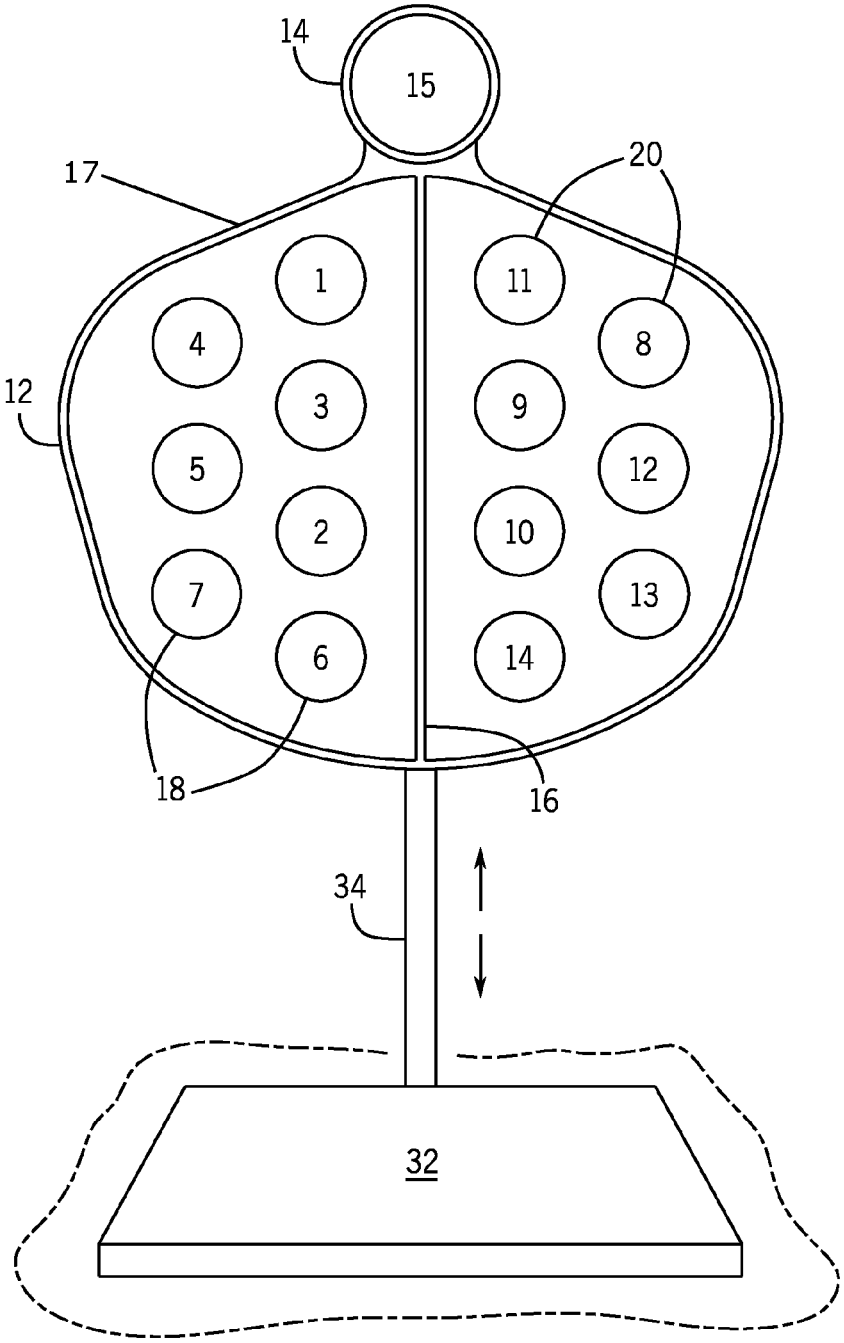
FIG. 3 is a front elevation view of the second embodiment of the present invention.

Referring to FIGS. 1 through 3, the present invention includes a boxing trainer 10. The boxing trainer 10 may include a housing 17 and a controller 22. The housing 17 includes a plurality of targets 18, 20. Each of the plurality of targets 18, 20 includes a target pad and a light operable to illuminate the target pad. The controller 22 includes a plurality of target buttons 26. Each target button 26 is linked to and corresponds with one of the targets 18, 20. Therefore, activating one of the target buttons 26 will activate the light of one of the target pads that the target button 26 is linked with. The controller 22 and the lights may be hard wired or wirelessly connected via wireless hardware.

In certain embodiments, the housing 17 may include a body portion 12 representing a body of a human, and a head portion 14 representing a head of a human. The body portion 12 may include a divider 16 running down the middle and separating the body portion 12 into a right side and a left side. The right side includes a plurality of right side targets 20 and the left side includes a plurality of left side targets 18. The head portion 14 may include a head target. The controller 22 may further include an outline 24 of the body portion 12 and the head portion 14 of the housing 17 with the target buttons 26 disposed within the outline 24. Each of the target buttons 26 may be located at a position within the outline 24 of the remote controller 22 that is equivalent to a position of the corresponding target location of the housing 17.

The targets 18, 20 may be numbered and the plurality of target buttons 26 may also be numbered. Matching numbers of the target buttons 26 and the target pads 18, 20 are linked. Therefore, activating one of the target buttons 26 will activate the light of the target pad that has the matching number. In certain embodiments, each of the plurality of targets 18, 20 includes an indicator that indicates to a training user to punch with either a right hand or left hand. The indicator may include different colored lights. For example, the right side targets 20 may include a red light, the left side targets 18 may include a green light, and the head target may include a yellow light. The red light may indicate to a training user to punch with their right hand, the green light may indicate to a training user to punch with their left hand, and the yellow light may indicate to a training user to punch with either hand or their dominate hand.

In certain embodiments, each of the target pads may include two different colored lights. For exemplary purposes, the two colored lights may be the green light and the red light. As illustrated in FIG. 2, the controller 22 may include a red and a green button 40. Either the red or green button 40 may be activated at the same time or right before one of the target buttons 26 is activated, thereby indicating to the training user to either use the right or left arm for the punch. For example, the red button 40 may be activated with the number 4 target button 26. The number 4 target 18 would light up red, thereby indicating to the training user to use their right hand to punch the number 4 target.

The controller 22 of the present invention may further include a speed button 38. The speed button 38 may be used to control the duration of time in which the lights of the targets 18, 20 are activated. For example, the speed button 38 may include a slow button, a fair button, an average button, a fast button, and a blinding button. The speed button 38 may be pressed before or simultaneously with a target button 26. When the slow button is activated, the light of the target 18, 20 will light up for the longest duration of time and when the blinding button is activated, the light of the target 18, 20 will light up for the shortest duration of time. For example, the slow level may light up for 1 and a quarter seconds, the fair level may light up for 1 second 18, 20, the average level may light up for three quarters of a second, the fast level may light up for a half of a second, and the blinding level may light up for a quarter second. The present invention may include a game for the general public as opposed to being a trainer for a professional boxer. In such embodiments, the slow level may light up for 5 seconds, the fair level may light up for 4 seconds, the average level may light up for 3 seconds, the fast level may light up for 2 seconds, and the blinding level may light up for 1 second.

In certain embodiments, the controller 22 may allow a trainer user to enter sequences of targets 18, 20 as well as the option to repeat or erase the sequence via a repeat or erase button 42. In such embodiments, the trainer user may activate a plurality of target buttons 26 with a certain speed button 38. The corresponding targets 18, 20 may light up at the entered speed. The trainer user may also activate the repeat button 42 and the same sequence that was previously entered is repeated. The plurality of sequences may be separated by a certain amount of time, such as 3 seconds, to allow the training user to regroup. Alternatively, the sequence may be erased using the erase button 42 and a new sequence may be created.

Each of the targets 18, 20 may further include an impact sensor. The impact sensor may sense that the target 18, 20 is hit and automatically turn of the light of the target 18, 20 that was hit and turn on the light of the target 18, 20 that is next in the sequence. In certain embodiments, the present invention may include a processor for counting the hits detected by the impact sensor. For example, the amount of times in which the training user hits within the timed duration and the amount of times when the training user is unable to hit within the time duration may be counted. At an end of a session, the tally may be projected to the user as a score. This also allows the present invention to be used as a game. More than one training user may use the present invention, and the training user with the higher score wins. The present invention may further include a speaker. The speaker may be activated if the training user is able to strike the training pad within the duration of time. The speaker may project a sound, such as the word "score".

The present invention may further include a base 32 and an extendable post 34. The base 32 supports the housing 17 in an upright position when the base 32 is resting on a surface. The post 34 may be adjustable in length, thereby simulating different sized opponents. The controller 22 may further include an adjustment command 36, such as an up and down button. The up button may activate the length of the post 34 to extend, and the down button may activate the length of the post 34 to retract. In certain embodiments, the number 4 target and the number 8 target may align with the training user's shoulders to simulate a similar sized opponent. However, the post 34 may be adjusted to different sizes depending on the size of the training user's future opponent.

The housing 17 of the present invention may be made of a sturdy polymer, such as a plastic. The housing 17 may house the electronic components of the present invention. The targets 18, 20 may include cut out portions within a front surface of the housing 17 with a target pad resting against an inner edge of the cut out portion. The target pad may include a circular shape and may be plastic. A spring may bias the target pad against the inner edge of the cut out portion on the inside of the housing 17. Therefore, when the training user strikes the target pad, the target pad may provide give, which prevents injury. Alternatively, the target pads may be made of a foam padding, which may also provide a sufficient give.

The computer-based data processing system and method described above is for purposes of example only, and may be implemented in any type of computer system or programming or processing environment, or in a computer program, alone or in conjunction with hardware. The present invention may also be implemented in software stored on a computer-readable medium and executed as a computer program on a general purpose or special purpose computer. For clarity, only those aspects of the system germane to the invention are described, and product details well known in the art are omitted. For the same reason, the computer hardware is not described in further detail. It should thus be understood that the invention is not limited to any specific computer language, program, or computer. It is further contemplated that the present invention may be run on a stand-alone computer system, or may be run from a server computer system that can be accessed by a plurality of client computer systems interconnected over an intranet network, or that is accessible to clients over the Internet. In addition, many embodiments of the present invention have application to a wide range of industries. To the extent the present application discloses a system, the method implemented by that system, as well as software stored on a computer-readable medium and executed as a computer program to perform the method on a general purpose or special purpose computer, are within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the invention as set forth in the following claims.

What is claimed is:

1. A boxing trainer comprising:

a housing comprising a body portion representing a body of a human, a head portion representing a head of a human, and a plurality of targets, each of the targets comprising a target pad and a light; and a remote controller comprising an outline of the body portion and the head portion of the housing and a plurality of target buttons disposed within the outline, wherein each of the plurality of target buttons corresponds with a corresponding target of the plurality of targets; and each of the plurality of target buttons is linked to the light of the corresponding target.

2. The boxing trainer of claim 1, wherein the body portion comprises a divider dividing the body portion into a right side and a left side.

3. The boxing trainer of claim 2, wherein both the right side and the left side comprises the plurality of targets.

4. The boxing trainer of claim 1, wherein the controller further comprises a speed button operable to control a duration in which the light is activated.

5. The boxing trainer of claim 1, further comprising a base and an extendable post attached to the housing and operable to support the housing in an upright position when resting on a surface.

6. The boxing trainer of claim 5, wherein the controller further comprises an adjustment button operable to control a height of the extendable post.

7. The boxing trainer of claim 1, wherein each of the plurality of target buttons are located at a position within the outline of the remote controller that is equivalent to a position of the corresponding target location of the housing.

* * * * *